United States Patent [19]

Gordon et al.

[11] 4,118,819

[45] Oct. 10, 1978

[54] FLOOR TREATING MACHINES

[75] Inventors: Sidney Gordon, Stanmore; John Thomas Wilkins, Bushey Heath; Haydn Frank Mayo, Hazlemere, all of England

[73] Assignee: R. G. Dixon & Company Limited, Wimley, England

[21] Appl. No.: 767,572

[22] Filed: Feb. 10, 1977

[30] Foreign Application Priority Data

Feb. 11, 1976 [GB] United Kingdom ..... 5442/76
Feb. 11, 1976 [GB] United Kingdom ..... 5443/76

[51] Int. Cl.[2] ..... A47L 11/162
[52] U.S. Cl. ..... 15/49 R; 51/177
[58] Field of Search ..... 15/49 R, 50 R, 98, 385, 15/79 R; 51/170 T, 177; 74/242.1 R, 242.1 TA

[56] References Cited

U.S. PATENT DOCUMENTS

| | | | |
|---|---|---|---|
| 1,847,323 | 3/1932 | Yutzler et al. | 15/49 R |
| 1,847,720 | 3/1932 | Marcellis | 74/242.1 R |
| 3,921,244 | 11/1975 | Warren et al. | 15/49 R X |

FOREIGN PATENT DOCUMENTS

| | | | |
|---|---|---|---|
| 401,579 | 1/1969 | Australia | 15/49 R |
| 81,712 | 11/1920 | Austria | 15/50 R |
| 2,055,799 | 5/1972 | Fed. Rep. of Germany | 15/49 R |
| 1,026,702 | 4/1966 | United Kingdom | 15/49 R |
| 1,417,424 | 12/1975 | United Kingdom | 15/49 R |

*Primary Examiner*—Edward L. Roberts
*Attorney, Agent, or Firm*—Michael J. Striker

[57] ABSTRACT

A floor treating machine of the single rotary brush type having a handle and a motor both laterally offset from the axis of rotation of the brush in a direction to impart a tilting couple opposed to that arising from operator forces counteracting the reaction couple on the handle.

6 Claims, 5 Drawing Figures

FLOOR TREATING MACHINES

This invention relates to floor treating machines of the single rotary brush type.

In this specification the term rotary brush is to be interpreted as including rotary polishing or buffing pads as well as rotary scrubbing or polishing brushes.

In a single rotary brush type of machine, there is a reaction couple tending to rotate the machine in a direction contrary to brush rotation and this has to be counteracted by the operator applying a force to the handle of the machine. Since the handle of the machine is vertically spaced from the plane of the reaction couple, this force in turn gives rise to a tilting couple on the machine, with the result that the machine has a tendency to operate with its brush not quite flat on the floor, and consequently to produce a force acting towards the operator.

In order to counteract this tendency, some forms of machines do have the motor offset laterally, and it is now proposed, according to the present invention, to offset both the handle and the motor laterally from the axis of rotation of the brush in a direction such that the weight of the motor and handle tends to apply a tilting couple opposed to that arising from operator forces counteracting the reaction couple via the handle.

By this means the weight of the handle is added to the weight of the motor to provide improved balance. It has not previously been realised that displacement of the handle in this way improved handling and reduces the force applied by the operator to obtain a given effect.

A further advantage of the offset handle is the provision of a low profile over a larger portion of the machine, which alloWs it to clean under radiators, cupboards, racks and other obstructions.

Further, it is normally necessary to provide a considerable speed reduction between the drive motor and the brush or brushes of a rotary brush floor treatment machine.

In many cases gearing is used to achieve the desired reduction, but it has been proposed to use a multiple V-belt driven by an offset motor and having opposite faces engaged with a driven pulley and a driving pulley. This arrangement enables the belt to be wrapped round a major arc of the driven pulley and also a substantial arc of the driving pulley.

Such drive system may also be used with a flat belt, as this leads to reduced power loss during the flexing of the belt round the small driving pulley and a longer belt life.

A belt in such a system needs to be tensioned by a jockey pulley, and according to the present invention there is also provided an improved belt tensioning system.

The present invention further consists in a floor treating machine of the rotary brush type with an offset motor, in which drive from the motor is supplied via a belt engaging one side with a small motor pulley and its other side with a major arc of a larger brush pulley to achieve speed reduction, in which the belt also passes over a tensioning jockey pulley mounted on a spring-loaded lever arm, and the position of the pivot point of the lever arm is adjustable.

Preferably, the pivot point of the arm is provided by a support stud mounted in a slot and securable at any desired position along the length of the slot.

The invention will be further described with reference to the accompanying drawings in which.

Figure 4:
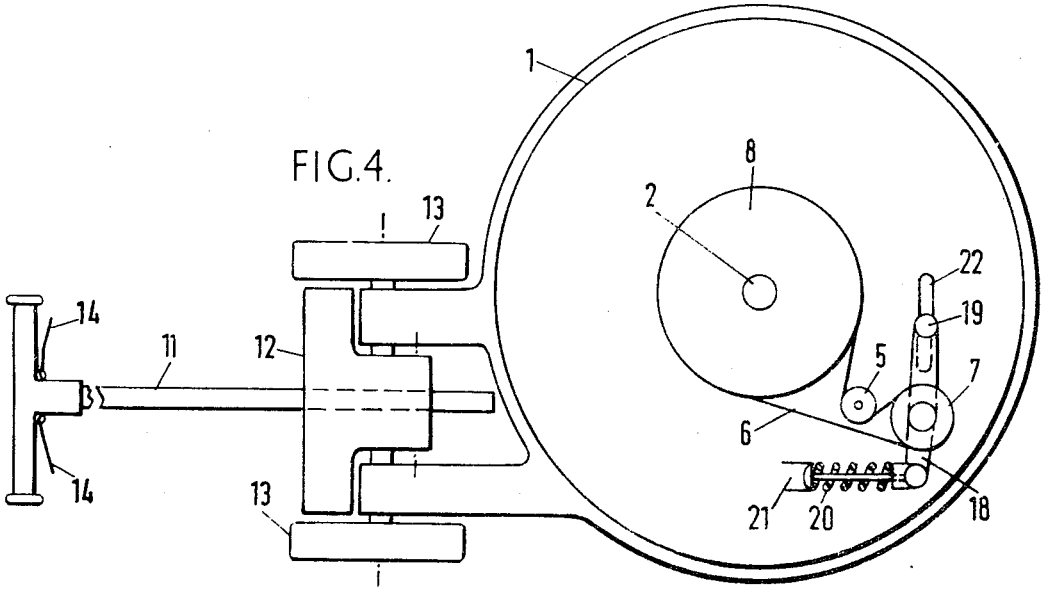
FIG. 4 is a bottom plan view of the machine of FIG. 3.

The type of machine illustrated is a single brush polisher in which a brush 1 is rotatable about its axis of rotation 2 and is mounted on a machine chassis 3 which also carries a motor mounted in a housing 4. FIG. 4 shows a motor driven pulley 5 which drives a belt 6 over a tensioning jockey pulley 7 and a brush drive pulley 8. It will be seen that the motor is offset forwardly and laterally of the axis 2, and it will also be seen that a handle 11 for the machine is also offset laterally, in this case the same distance as the offsetting of the axis of rotation of the motor. The handle 11 is pivoted to the chassis 3, and is lockable in a selected one of a plurality positions by means of a foot pedal 12 mounted in the region of transport wheel 13. The handle 11 carries conventional controls 14 for the machine. It will be appreciated that in normal use the transport wheels are out of contact with the ground, and are only used for manoeuvring the machine from place to place, and not during polishing.

Having a handle lock operated by the foot pedal 12 has been found to discourage the dangerous practice of changing the position of a handle while the machine is running.

Figure 1:
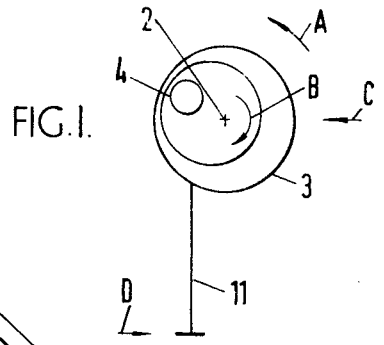
FIG. 1 is a diagrammatic plan view of a form of floor treating machine according to the invention, illustrating some of the forces involved in operation.
Figure 2:
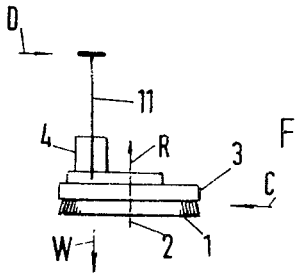
FIG. 2 is a rear elevation complementing FIG. 1.
Figure 3:
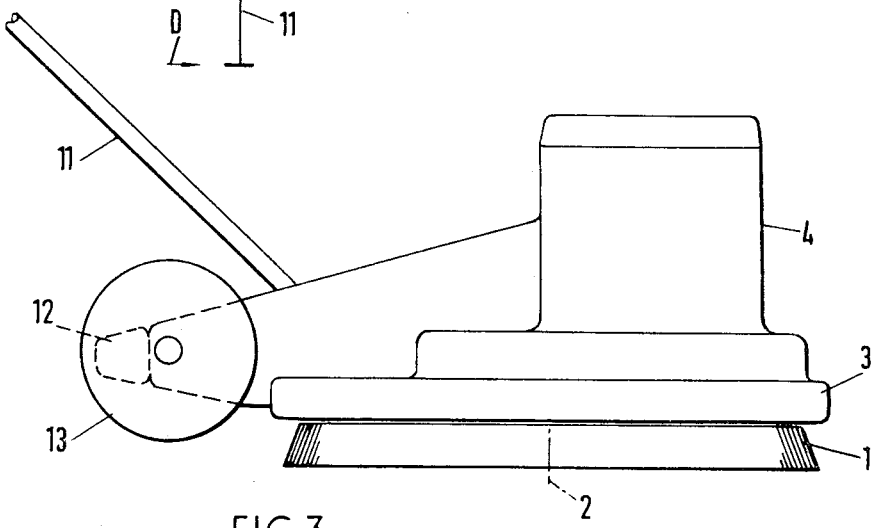
FIG. 3 is a diagrammatic side elevation of a practical form of machine according to the present invention.

Referring now particularly to FIG. 1, it will be seen that with the brush rotating in the direction of the arrow A, there is a reaction torque in the direction indicated by the arrow B, and this reaction torque has itself to be reacted, partially by a frictional force laterally of the machine and illustrated by the arrow C, and partly by an opposite sideways force indicated by the arrow D and applied by the operator to the handle of the machine. However, since the point of application of the force D to the handle is necessarily some distance above the floor, it will be seen that the forces C and D themselves give rise to a tilting couple, and this itself must be reacted, at least in part, by the weight of the handle and motor indicated by the arrow W acting against the reaction from the floor, indicated by the arrow R acting generally along the axis of rotation 2. It will thus be seen that by off-setting both the motor and the handle, which constitute a considerable portion of the weight of the machine, to the same side of the axis of rotation 2, a fairly substantial tilting couple is applied to the machine which assists in reacting the reaction torque arising on rotation of the brush. The offsetting thus provides assistance to the operator and improves the handling ability of the machine.

It will be seen that the drive is transmitted from the motor pulley 5 to the brush pulley 8, which is much larger than the pulley 5 and therefore gives rise to a speed reduction. The drive is transmitted by the belt 6 which passes over an arc of the pulley 5 which exceeds 90°, and the belt then passes with its opposite face over a major arc of the jockey pulley 7 and then over about three-quarters of the brush pulley 8, using the same face as on the jockey pulley 7. The jockey pulley 7 is mounted on a lever arm 18 which is pivoted at one end on a stud 19 and at the other end has a tensioning force applied to it by a spring 20 reacting against a fixed abutment 21 on the machine chassis. In order to provide for an adjustment of the initial position of the jockey pulley, and to obtain some control of the amount of wrap around of the motor pulley 5, the stud 19 is slidably mounted in a slot 22 in the machine chassis, and may be secured at any position along the length of the slot by means of a wing nut or other securing device on the upper surface of the machine. The securing device is shown as a nut 41 in FIG. 5.

Figure 5:
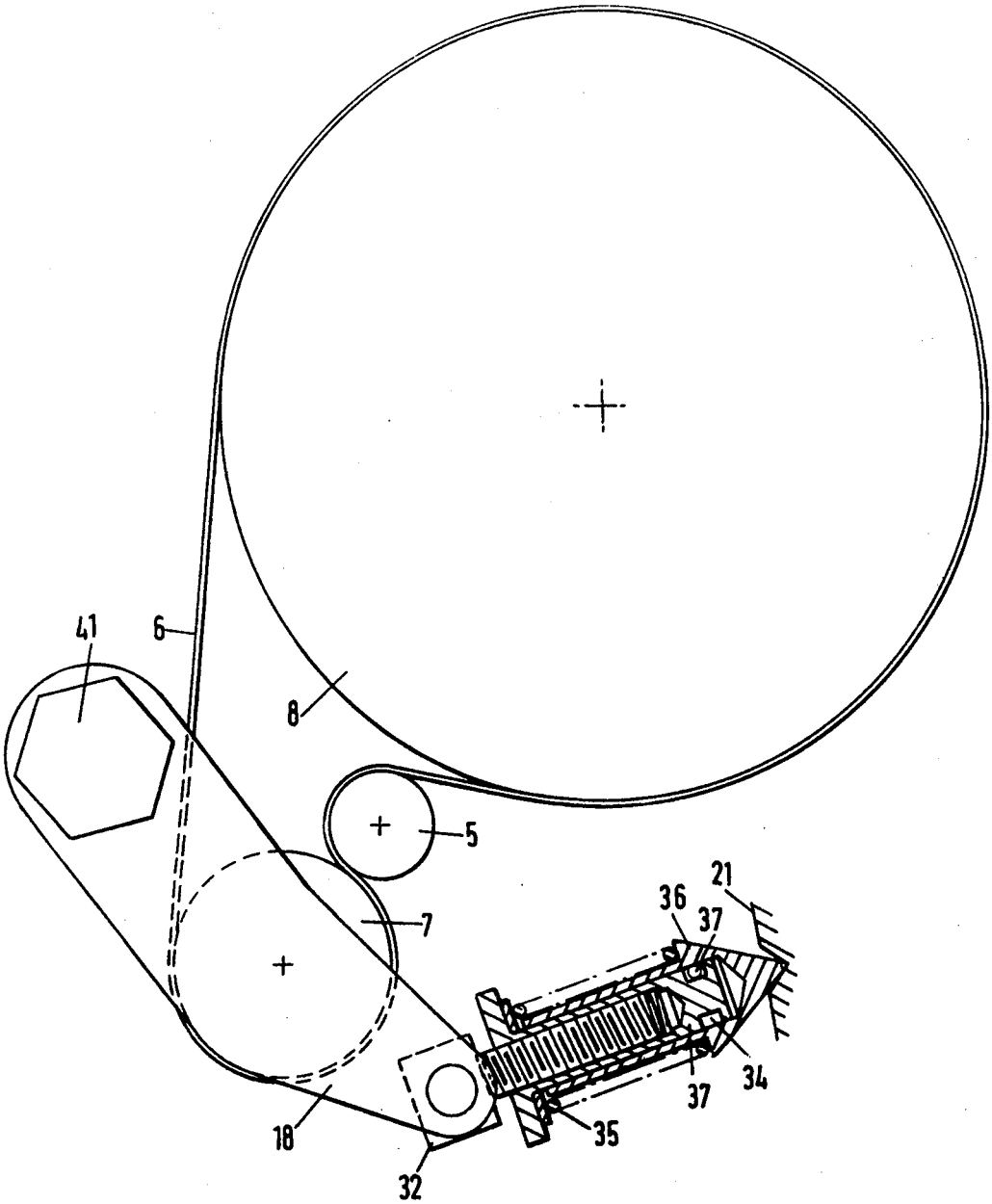
FIG. 5 illustrates an improved spring tensioning device.

FIG. 5 shows a spring tensioning cartridge to replace the single spring 20. The principle object of the device is to enable precise belt tension to be achieved without any tedious setting-up procedures.

The cartridge consists of an adjustable head or end 32 which screws into a spring retainer 33 which has a groove 34 machined at its inner end. The spring retainer 33 has a spring 35 held in compression against a spring holder 36 which has a point rockably mounted in a notch provided in the abutment 21. The spring retainer 33 holds the spring 35 in compression by virtue of a pin, not shown, which passes through a hole 38 in the spring holder 36 and the groove 34 in the spring retainer 33.

By suitable dimensioning of these components a known amount of axial force can be achieved when a spring of known rate is held in compression by the pin. It will be appreciated that if the cartridge is now fitted to the machine with the adjustable end 32 screwed in or out to enable the cartridge to just fit the space available for it, (with all the slack taken out of the belt by hand) removal of the pin will result in a known amount of belt tension being achieved, without any further adjustment. As illustrated, when the pin 37 is removed the compression spring 35 will move spring retainer 33 and head 32 to the left as viewed in FIG. 5. This will cause the pulley 7 to move in a direction away from the brush pulley 8 and therefore increase the length of the belt path and hence the tension of belt 6.

If, in service, it is found necessary to adjust the belt tension, due perhaps to belt stretch, the procedure is to compress the cartridge, fit a suitable pin, re-adjust the adjustable end 32 to give a minimum clearance for the cartridge and remove the pin.

This Figure also illustrates a nut 41 for the stud 19.

Various modifications may be made within the scope of the invention.

We claim:

1. A floor treating machine of a single rotary brush type, comprising a frame disposed substantially horizontally to the floor and having a lower surface and an upper surface; at least two wheels rotatably mounted on said frame; a brush rotatably mounted on said lower surface of said frame and rotatable about a vertical axis; a motor fixedly mounted on said upper surface of said frame and operative to rotate said brush about said axis, said brush during rotation being subjected to a reaction couple with the floor; a handle for an operator and attached to said frame at an end thereof and extending angularly upward and away from said frame, so that an operator can apply forces to said handle to counteract the reaction couple on said brush and thereby create a tilting couple, said handle and said motor being laterally offset on said frame from said axis of rotation of the brush in a direction so as to impart a tilting couple opposed to that arising from operator forces applied to the handle to thereby counteract the reaction couple acting on said brush from the floor.

2. A floor treating machine as claimed in claim 1, in which the motor and handle are laterally offset by substantially the same distance.

3. A floor treating machine as claimed in claim 1 comprising a transmission from the motor to the brush including a small motor pulley, a larger brush pulley, a tensioning jockey pulley and a belt having one side engaged with the motor pulley and its other side engaged with a major arc of the brush pulley, and a spring loaded pivoted lever arm carrying the jockey pulley, the pivot point of the lever arm being adjustable.

4. A floor treating machine as claimed in claim 3 comprising a stud providing the pivot point for the lever arm, the said stud being mounted on a slot and being provided with means to secure the stud and any desired position along the length of the slot.

5. A floor treating machine as claimed in claim 3, in which a spring cartridge of adjustable length provides the spring loading of the lever arm.

6. A floor treating machine as claimed in claim 5, in which the spring cartridge comprises a spring holder, a spring retainer telescopically slidable with spring holder and securable in a pre-set position thereon, a spring compressed between the spring holder and the spring retainer, and a head for attachment to the lever arm and axially adjustably mounted on the spring retainer as to vary the affective length of the cartridge when the spring retainer is in the pre-set position.

* * * * *

UNITED STATES PATENT AND TRADEMARK OFFICE

CERTIFICATE OF CORRECTION

PATENT NO. : 4,118,819

DATED : October 10, 1978

INVENTOR(S) : Sidney Gordon et al.

It is certified that error appears in the above-identified patent and that said Letters Patent are hereby corrected as shown below:

In the heading, the address of the assignee should read:

-- Wembley, England --.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*